US006619091B2

(12) United States Patent
Heffe

(10) Patent No.: US 6,619,091 B2
(45) Date of Patent: Sep. 16, 2003

(54) QUICK-CHANGE SYSTEM FOR MEASURING PROBE ASSEMBLY

(75) Inventor: Roland Heffe, Korschenbroich (DE)

(73) Assignee: Hegenscheidt-MFD GmbH & Co. KG, Erkelenz (DE)

( * ) Notice: Subject to any disclaimer, the term of this patent is extended or adjusted under 35 U.S.C. 154(b) by 9 days.

(21) Appl. No.: 10/007,684

(22) Filed: Dec. 4, 2001

(65) Prior Publication Data

US 2002/0069689 A1 Jun. 13, 2002

(30) Foreign Application Priority Data

Dec. 4, 2000 (DE) ..... 100 60 219

(51) Int. Cl.[7] ..... B21D 15/00; G01D 21/00

(52) U.S. Cl. ..... 72/110; 72/8.9; 72/11.6; 33/605

(58) Field of Search ..... 72/8.3, 8.9, 11.1, 72/11.6, 12.7, 16.2, 16.3, 16.4, 16.8, 17.3, 18.6, 110, 107; 33/605, 549, 555.1

(56) References Cited

U.S. PATENT DOCUMENTS 3,905,116 A * 9/1975 Roberts ..... 33/605
4,154,073 A * 5/1979 Galdabini ..... 72/389.1
4,651,438 A * 3/1987 Hutter et al. ..... 33/550
5,123,173 A * 6/1992 Possati et al. ..... 33/605
5,542,188 A * 8/1996 Ertl et al. ..... 33/605
6,098,452 A * 8/2000 Enomoto ..... 73/104

* cited by examiner

*Primary Examiner*—Ed Tolan
(74) *Attorney, Agent, or Firm*—Carlson, Gaskey & Olds

(57) ABSTRACT

On a hard-rolling machine (41) for crankshafts (1) there is provided a plurality of measuring probes (4) corresponding to the number of main bearings (3) to be measured, which are arranged on a measuring-probe bridge (6) with the mutual spacing (5). The measuring-probe bridge (6) is detachably connected via quick couplings to the free ends of swivel arms wherein as cable connection between the measuring probes (4) and an evaluation device there is provided a detachable cable plug which connects each measuring probe (4) to the evaluation device. The measuring-probe bridge (6) can be removed from the hard-rolling machine (41) together with the cable plug and then re-attached thereto, depending on which type of crankshaft (1) is to be hard-rolled.

20 Claims, 5 Drawing Sheets

G - G

QUICK-CHANGE SYSTEM FOR MEASURING PROBE ASSEMBLY

RELATED APPLICATIONS

This patent application claims priority to German Patent Application No. 100 60 219.3-51 filed Dec. 4, 2000.

BACKGROUND OF THE INVENTION

The invention relates to a hard-rolling machine for crankshafts according to the preamble of the main claim.

During hard rolling of recesses or radii on crankshafts there is a possibility that the crankshaft may buckle. Because of this purpose the crankshaft is measured after the hard-rolling operation to determine whether it exhibits any eccentricity. This measurement is generally made using measuring probes which are lowered onto one or several of the main bearings of the crankshaft after the hard-rolling operation and are connected electrically to an evaluation device. During the measurement the crankshaft makes one revolution about its longitudinal axis. The quality of the hard-rolled crankshaft is determined by allocating one measuring probe respectively to each of the crankshaft main bearings. According to the measurement result a further hard-rolling operation can then follow in which the radii or recesses of individual bearing sites are specifically re-rolled. This re-rolling can extend over the entire circumference of the relevant bearing site or it can however merely involve part of the circumference. This re-rolling can embrace the radii or recesses at individual main bearings or at crankpin bearings of the crankshaft.

High requirements are imposed on the measurement accuracy of the eccentricity measurement. For example, for a crankshaft having an overall length of approximately 400 mm it is still necessary to measure an eccentricity at the central main bearing which is of the order of magnitude of $10^{-2}$ mm.

On the basis of the particular measurement result the hard-rolling operation is regulated at the hard-rolling machine via the evaluation device. Usually a plurality of measuring probes corresponding to each main bearing is arranged along the crankshaft. As a result of the mutual spacings separating the measuring probes one from the other, the configuration is in each case only suitable for a specific type of crankshaft. However, modern hard-rolling machines for crankshafts are designed so that several types of crankshaft can be machined one after the other. This means however that the setting of the measuring probes must be adjusted from one type of crankshaft to another. For example, the hard rolling of a crankshaft for a three-cylinder engine requires a smaller number of measuring probes than the hard-rolling of crankshafts for engines having a larger number of cylinders. Thus, the hard-rolling machine for the crankshafts must be retooled each time when different types of crankshaft are to be machined on it. Regardless of the changing of the hard-rolling tools thus involved, the measuring probes must be re-aligned each time with the required accuracy so that the hard-rolling operation is successful.

Thus the object for the present invention is to attach measuring probes exchangeably to the hard-rolling machine in the required number and in a pre-prepared configuration according to the particular type of crankshaft to be hard-rolled. In addition to the required measurement accuracy, it must also be ensured that the multiple connection of the measuring probes with the evaluation device can be made extremely carefully and reliably and in the shortest time.

Finally the time taken to retool from one group of measuring probes to another should be as short as possible and the attachment of the measuring probes should be as easy as possible.

SUMMARY OF THE INVENTION AND ADVANTAGES

The object is achieved by the characterising features of the main claim. There is provided a measuring-probe bridge on which is provided a plurality of measuring probes corresponding to the number of main bearings to be measured, which are arranged with a mutual spacing one from the other. The measuring-probe bridge can be connected via a quick coupling to the free end of the arm which is provided to engage the measuring probes with the crankshaft. The quick coupling is configured so that at the same time it is also possible to make the cable connection via which the individual measuring probes are connected to the evaluation device. In the present case the cable connection is a multi-pole plug which ensures careful and high-precision joining of the individual cables one to the other, which are assigned to each measuring probe. The quick coupling ensures that the measuring probes can be attached to the hard-rolling machine easily and without canting. At the same time the measuring probes are coupled to the evaluation device with the greatest possible care of the plug connection. Each type of crankshaft is allocated its own measuring-probe bridge on which the individual measuring probes are attached according to type. Since the individual measuring-probe bridges can be exchanged quickly, the setting period of the hard-rolling machine is reduced substantially.

Particularly advantageous is the design of the quick coupling as an adjusting sleeve in which a pin can be inserted to secure measuring probes, which for its part is part of the measuring-probe bridge and can be unlocked by axially sliding a connecting bush. Adjusting sleeves of said type are known for example from DIN 55 058. The adjusting sleeves known from the standard are used to connect tools with the spindle heads of machine tools. On the basis of the DIN standard the adjusting sleeves or tool holders were further developed in such a way that they can changed quickly without additional tools and can be locked by pushing into the spindle of the machine tool. Unlocking is achieved by axially sliding a connecting bush. A corresponding system has been reported under the model designation ASBVA in a publication by Otto Bilz Werkzeugfabrik GmbH & Co., 73760 Ostfildern.

Secure coupling and uncoupling of the measuring probes bridge with the hard-rolling machine is achieved if two arms in the same geometrical configuration are connected secure against rotation to the shaft, these being provided to engage the measuring probes with the crankshaft on the hard-rolling machine. Each of the two arms then also has its own adjusting sleeve. The free ends of the two arms are connected to each other via a plate. The adjusting sleeves for the quick coupling are attached to the plate at the side next to the arms.

In order to ensure that the measuring-probe bridge can be attached to the hard-rolling machine as far as possible without canting and therefore with ease of action, one of the adjusting sleeves is connected via a hinge to the plate which for its part connects the ends of the two arms together. Certain manufacturing tolerances which are unavoidable in the manufacture of a measuring probes bridge can at the same time be taken up by this hinge. By means of this hinge any canting of the measuring-probe bridge as it is attached to the hard-rolling machine is largely excluded whereby the ease of action of the connection and also the measurement accuracy are ensured. In order to protect the electrical contacts parts of the detachable plug connection which lead to the evaluation device are also rigidly connected to the plate.

As is inherently usual, every measuring probe in the position of engagement with the crankshaft is vertical. During hard rolling of the crankshaft the measuring probes are swivelled out of engagement and then assume an approximately horizontal position. In this swung-out position of the measuring probes the hard-rolling tools can hard-roll the radii or necks of the crankshaft unhindered.

BRIEF DESCRIPTION OF THE DRAWINGS

The invention will now be described in greater detail with reference to an embodiment example. The drawings are in each case on a reduced scale where.

DETAILED DESCRIPTION OF THE PREFERRED EMBODIMENT

Figure 1:
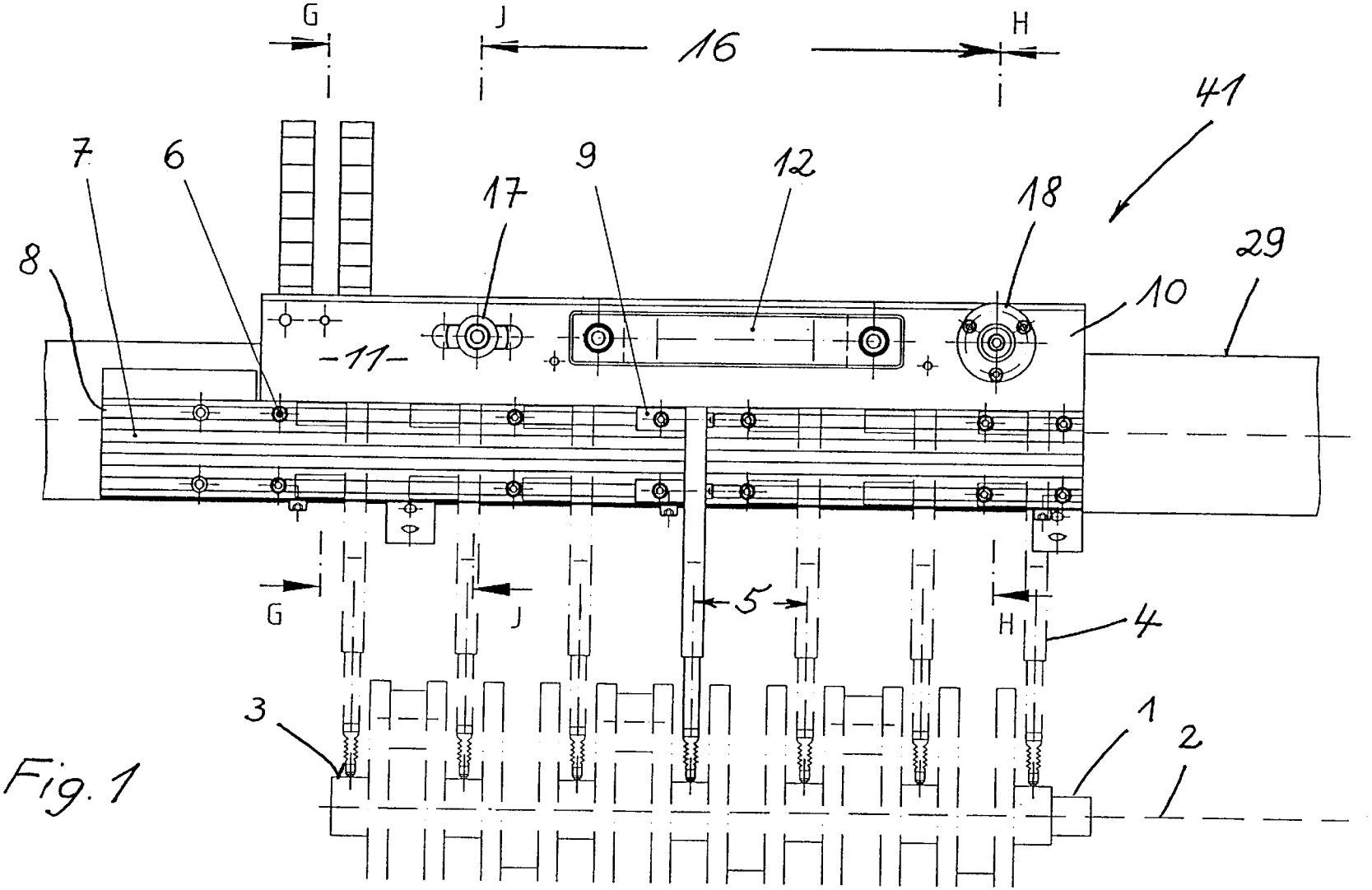
FIG. 1 is a front view of the measuring-probe bridge.

FIG. 1 shows in dashed lines a crankshaft 1 such as that used, for example in a six-cylinder series engine for passenger cars. Along the axis of rotation 2 of the crankshaft 1 the main bearings 3 are arranged with a mutual spacing one from the other. A measuring probe 4 engages with each main bearing 3. The upper ends of the measuring probes 4 are attached to a measuring-probe bridge 6 at mutual spacings 5 corresponding to the configuration of the main bearings 3. The measuring-probe bridge 6 consists of a profile strip 7 in whose grooves 8 slidable prismatic blocks 9 are attached. Each upper end of a measuring probe 4 is screwed onto two prismatic blocks 9.

Figure 2:
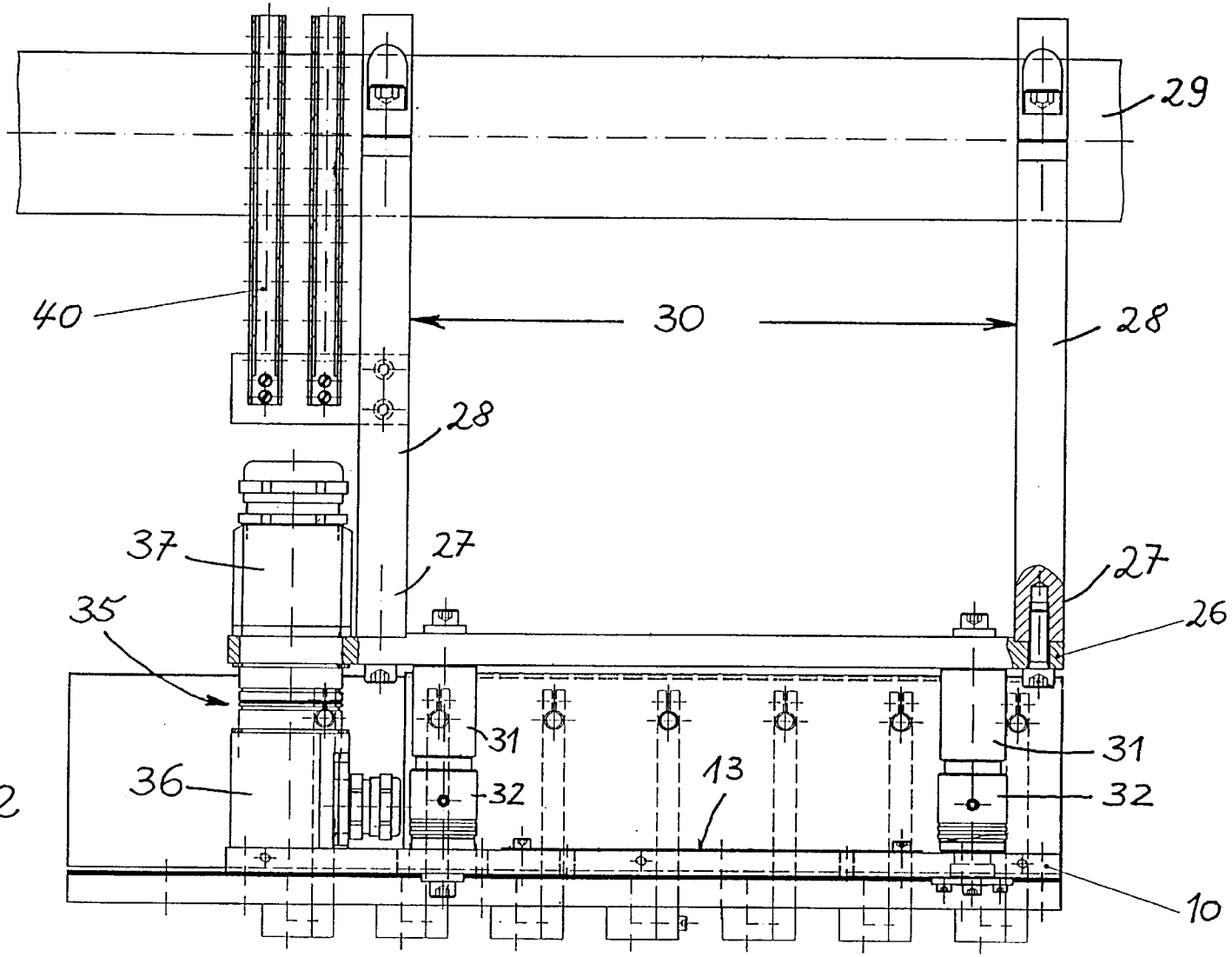
FIG. 2 is a top view of the measuring-probe bridge.
Figure 6:
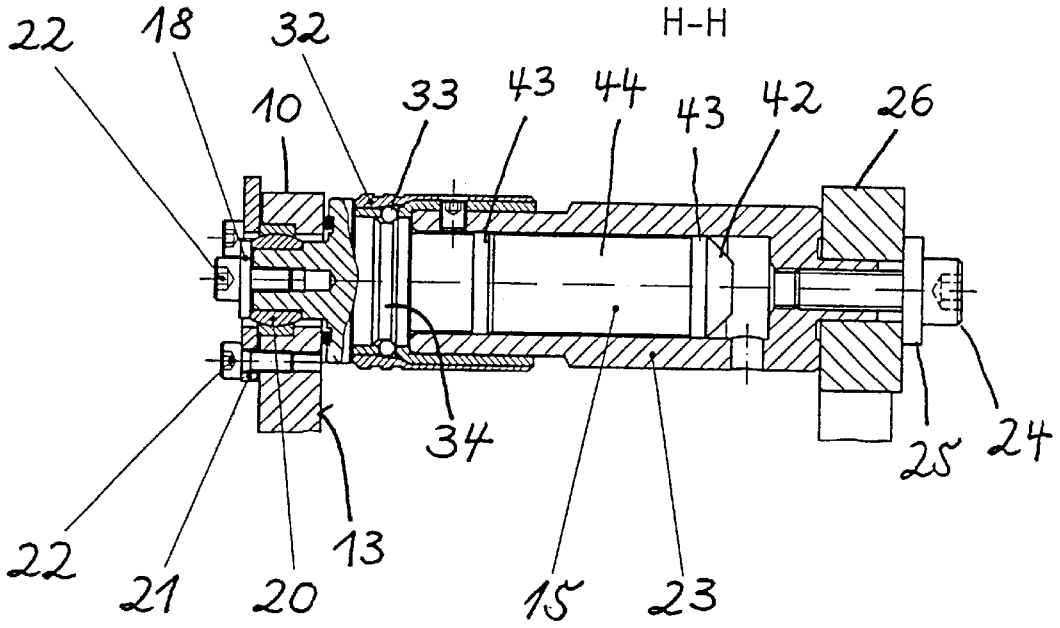
Figure 5:
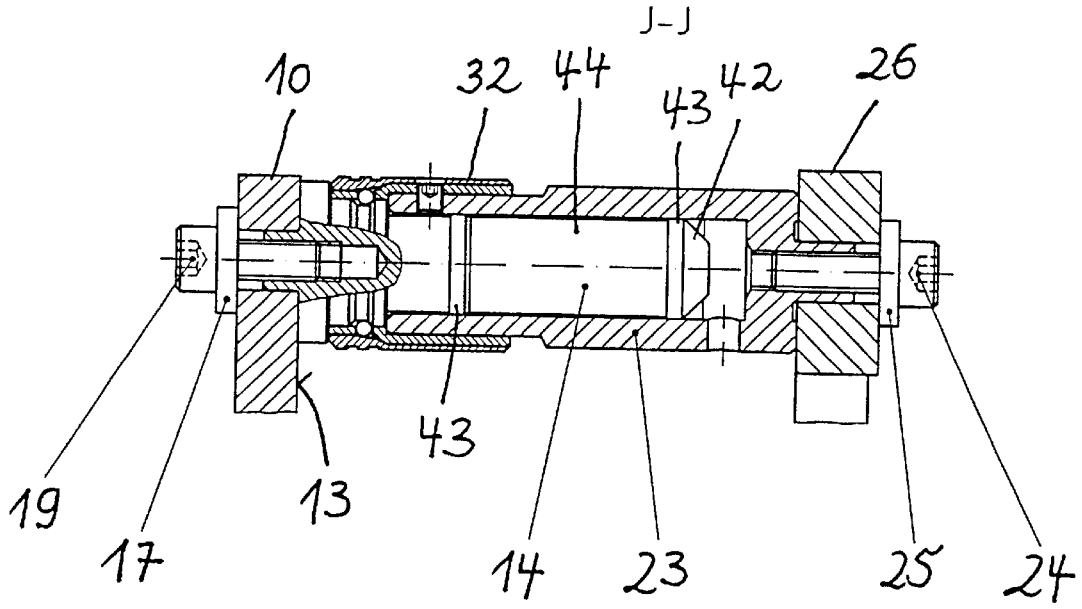

The profile strip 7 is attached to a plate 10. On the upper side 11 carrying the profile strip 7 the plate 10 has a handle 12. On the reverse upper side 13 of the plate 10 facing the upper side 11 (FIG. 2) two pins 14 and 15 project vertically (FIGS. 5 and 6). The two pins 14 and 15 have a mutual spacing which corresponds to the spacing 16 between the two section lines J—J and H—H (FIG. 1). The horizontal height position of the two pins 14 and 15 on the plate 10 is the same and extends parallel to the longitudinal axis 2 of the crankshaft 1; in FIG. 1 this can be seen from the respective fixings 17 and 18 for the pins 14 and 15. Whereas the fixing 17 for the pin 14 can be identified as the screw connection 19 in FIG. 5, the fixing 18 for the pin 5 at the plate 10 is configured as the hinge 20. The hinge 20 is held on the plate 10 by a plate 21 and screws 22; it is moveable to a limited extent in all directions.

The pins 14 and 15 respectively engage in similar adjusting sleeves 23 which are attached to a strip 26 by means of screws 24 below each of which is located a washer 25. The strip 26 connects together the outer free ends 27 of two arms 28 which are attached to a shaft 29 secure against rotational and with the mutual spacing 30 one from the other.

In the same way as the two pins 14 and 15, the adjusting sleeves 23 are parts of two quick couplings 31 by means of which the measuring-probe bridge 6 can be connected to the strip 26 and thus to the arm 28 and the shaft 29 of the hard-rolling machine. The measuring-probe bridge 6 is connected to the hard-rolling machine 41 by simply inserting the pins 14 and 15 into the respective adjusting sleeves 23. Conically shaped ends 42 make it easier to insert the pins 14 and 15 into the adjusting sleeves 23; collars 43 on their shaft 44 ensure an accurate fit and easy action of the pins 14 and 15 inside the adjusting sleeves 23. The measuring-probe bridge 6 is to be detached therefrom by means of connecting bushes 32 which for their part are guided axially moveably on the outer section of the adjusting sleeves 23. Balls 33 which are supported in an annular groove 34 of the two pins 14 and 15 form the actual connection between the relevant pins 14, 15 and the adjusting sleeve 23. By moving the connecting bushes 32 axially in the direction of the plate 10, the balls 33 can emerge from the annular grooves 34 and the measuring-probe bridge 6 is thus released from the hard-rolling machine 41.

Each of the measuring probes 4 is electrically connected to an evaluation device (not shown) via a cable plug 35. The cable plug 35 consists of a part 36 which is attached to the measuring probe bridge 6 and a part 37 which is attached to the strip 26. Whereas the part 37 is permanently connected to the hard-rolling machine 41 via the strip 26, the engaging of the part 36 into the part 37 of the cable plug 35 changes with every change of the measuring-probe bridge 6. The quick coupling 31 is of such accuracy that the large number of individual connections of the measuring-probe bridge 6 corresponding to the individual measuring probes 4 can be made without any problems inside the cable plug 35 via the two parts 36 and 37 without parts of the sensitive lead ends becoming damaged.

Figure 4:
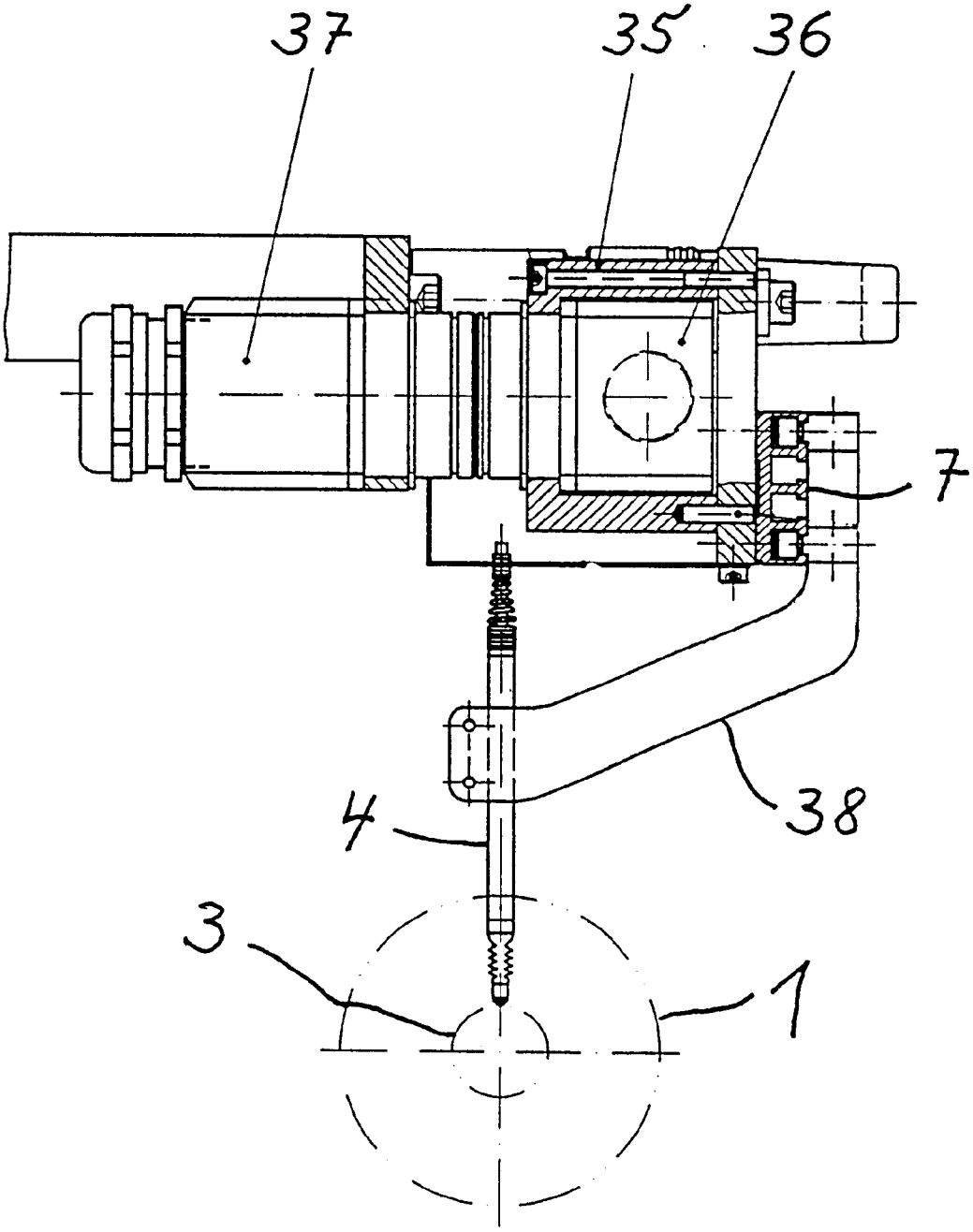
FIGS. 4, 5 and 6 are respectively sections through the measuring-probe bridge along the lines G—G, J—J and H—H in FIG. 1.

FIG. 4 shows one of the measuring probes 4 engaged with a main bearing 3 of a crankshaft 1. As can be seen from FIG. 4, the measuring probe 4 is held by a curved arm 38 whose other end is attached to the profile strip 7. The cable plug 35 with its two ends 36 and 37 can be seen very clearly from FIG. 4.

Figure 3:
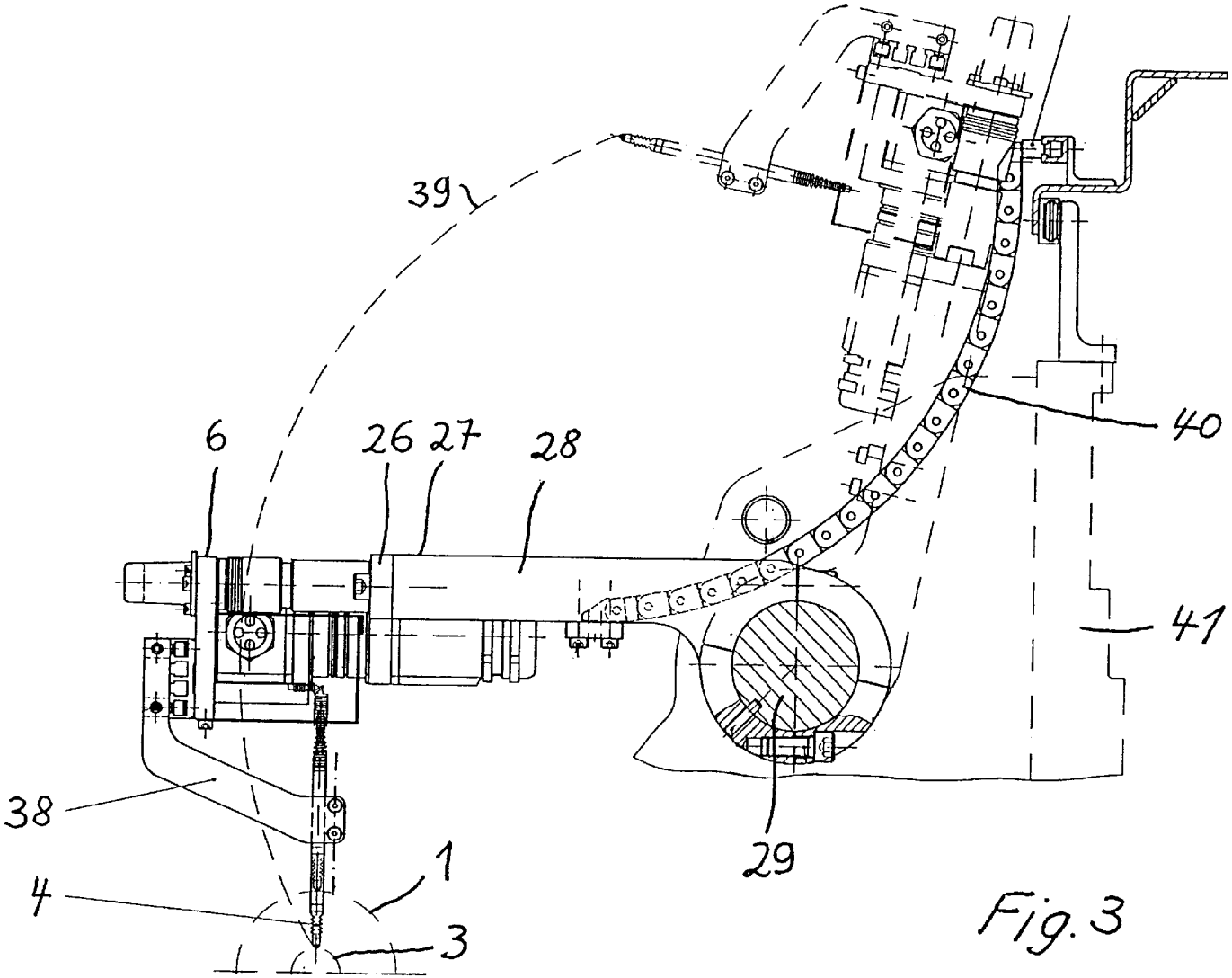
FIG. 3 is a side view of the measuring-probe bridge.

FIG. 3 shows the measuring probe bridge 6 respectively in the working and in the rest position. In the working position in the left half of FIG. 3 the measuring probe 4 is lowered onto the crankshaft 1 and stands almost vertically on one of the main bearings 3. In the right half of FIG. 3 the measuring-probe bridge 6 is shown in the rest position. On transition from the working to the rest position the tip of the measuring probe 4 describes an arc. A supporting chain 40 protects the cable emerging from the part 37 of the cable plug 35 (not shown) from being damaged as the measuring probe 4 swivels along the arc 39. The shaft 29 with its arms 28 and the strip 26 connecting the ends of the arms 28 are parts of the hard-rolling machine 41 which remain thereon permanently.

The invention has been described in an illustrative manner, and it is to be understood that the terminology that has been used is intended to be in the nature of words of description rather than of limitation. Obviously, many modifications and variations of the present invention are possible in light of the above teachings. It is, therefore, to be understood that within the scope of the appended claims the invention may be practiced otherwise than as specifically described.

What is claimed is:

1. A hard-rolling machine for crankshafts with an apparatus for measuring the eccentricity of the crankshaft, at least one measuring probe which is arranged in a mounting support at the free end of an arm, which is connected secure against rotation to a shaft which extends axially parallel to the crankshaft and by swivelling about its longitudinal axis brings the measuring probe into and out of engagement with one of the main bearings of the crankshaft and a cable connection by means of which the measuring probe is connected to an evaluation device, a plurality of measuring probes axially-spaced from one another in a direction generally parallel to the crankshaft to measure a corresponding number of main bearings, the plurality of measuring probes arranged on a measuring-probe bridge which via at least one quick coupling is detachably connected to a free end of at least one arm, and a cable connection is a detachable plug connection for accurately connecting each measuring probe to the evaluation device.

2. A hard-rolling machine according to claim 1, wherein the quick coupling is constructed as an adjusting sleeve into which can be inserted to attach measuring probes a pin which is part of the measuring-probe bridge and can unlocked by axially sliding a connecting bush.

3. A hard-rolling machine according to claim 2, wherein two arms with a same geometrical configuration are connected secure against rotation to the shaft, each having an adjusting sleeve assigned thereto.

4. A hard-rolling machine according to claim 3, wherein the fire ends of the two arms are connected together via a strip.

5. A hard-rolling machine according to claim 4, wherein the adjusting sleeves are attached to the strip at the side next to the arms.

6. A hard-rolling machine according to claim 5, wherein one of the pins is connected via a binge to a plate on which the measuring-probe bridge is secured.

7. A hard-rolling machine according to claim 4, wherein parts of the detachable plug connection which lead to the evaluation device are rigidly connected to the plate or the strip.

8. A hard-rolling machine according to claim 1, wherein each measuring probe stands generally vertically in the position of engagement with the crankshaft.

9. A hard-rolling machine for crankshafts having an apparatus for measuring the eccentricity of the crankshaft, the machine comprising:

a machine support structure;

an eccentricity apparatus support member having a first end connected to said machine support member, said eccentricity apparatus support member having a second end opposite said first end; and an eccentricity measurement assembly removably supported on said second end by a quick connect device with said eccentricity measurement assembly including a measurement probe for engaging the crankshaft, the quick connect device including at least one ball supported in a recess of a pin and an axially-movable bush for releasing the quick connect device.

10. The machine according to claim 9, wherein said eccentricity apparatus support member includes a shaft at said first end rotatably supported by said machine support structure for rotating said eccentricity measurement assembly into and out of engagement with the crankshaft.

11. The machine according to claim 10, wherein arms extend from said shaft and support a strip at said second end apposite and generally parallel to said shaft with said eccentricity measurement assembly supported on said strip.

12. The machine according to claim 11, wherein said eccentricity measurement assembly includes a plate removably supported on said strip by said quick connect device.

13. The machine according to claim 12, wherein eccentricity measurement assembly includes an arm supporting said measurement probe laterally adjustably supported on said plate by complementary interlocking features.

14. The machine according to claim 13, wherein said interlocking features include a complementary shaped groove and block.

15. The machine according to claim 9, wherein said quick connect device includes a pair of spaced apart quick couplings.

16. The machine according to claim 15, wherein eccentricity measurement assembly includes a plurality of measurement probes each with at least one wire, said quick connect device including a cable plug assembly including first and second cable plug portions with said wires terminating in said first cable plug portion which is supported on said eccentricity measurement assembly, and said second cable plug portion supported on said eccentricity apparatus support member removably receiving said first cable plug portion.

17. A hard-rolling machine for crankshafts having an apparatus for measuring the eccentricity of the crankshaft, the machine comprising:

a machine support structure;

an eccentricity apparatus support member having a first end connected to said machine support member, said eccentricity apparatus support member having a second end opposite said first end; and an eccentricity measurement assembly having a plate supported on said second end, an arm laterally adjustably supported on said plate by complementary interlocking features with said arm including at least one measuring probe for engaging the crankshaft.

18. The machine according to claim 17, wherein said interlocking features include a complementary shaped groove and block.

19. The machine according to claim 17, wherein said eccentricity apparatus support member includes a strip at said second end with a quick connect device removably interconnected said strip and said plate, wherein the at least one measuring probe includes a plurality of measuring probes mounted to said plate, each of the said plurality of measuring probes arranged for engaging a different one of a plurality of bearings on the crankshaft.

20. The machine according to claim 19, wherein quick connect device includes a quick coupling and a cable plug, the quick coupling including at least one ball supported in a recess of a pin and an axially-movable bush for releasing the quick connect device.

* * * * *

UNITED STATES PATENT AND TRADEMARK OFFICE

CERTIFICATE OF CORRECTION

PATENT NO. : 6,619,091 B2
DATED : September 16, 2003
INVENTOR(S) : Roland Heffe

It is certified that error appears in the above-identified patent and that said Letters Patent is hereby corrected as shown below:

Column 5,
Line 21, should read as follows:
-- be unlocked by axially sliding a connecting bush. --
Line 27, “fire” should be -- free --
Line 33, “binge” should be -- hinge --

Column 6
Line 5, “apposite” should be -- opposite --
Line 10, should read as follows:
-- The machine according to Claim 12, wherein said --

Signed and Sealed this

Twenty-third Day of December, 2003

JAMES E. ROGAN
*Director of the United States Patent and Trademark Office*